US008109291B2

(12) United States Patent
Fuegel et al.

(10) Patent No.: US 8,109,291 B2
(45) Date of Patent: Feb. 7, 2012

(54) ARRANGEMENT FOR CONVEYING CONCRETE WITH A HEIGHT-ADJUSTABLE CONCRETE DISTRIBUTING MAST

(75) Inventors: Dietmar Fuegel, Wolfschlugen (DE); Martin Mayer, Reutlingen (DE)

(73) Assignee: Putzmeister Engineering GmbH, Aichtal (DE)

( * ) Notice: Subject to any disclaimer, the term of this patent is extended or adjusted under 35 U.S.C. 154(b) by 462 days.

(21) Appl. No.: 12/310,169

(22) PCT Filed: Jun. 27, 2007

(86) PCT No.: PCT/EP2007/056405

§ 371 (c)(1),
(2), (4) Date: Feb. 13, 2009

(87) PCT Pub. No.: WO2008/025582

PCT Pub. Date: Mar. 6, 2008

(65) Prior Publication Data

US 2009/0252575 A1 Oct. 8, 2009

(30) Foreign Application Priority Data

Aug. 28, 2006 (DE) ..... 10 2006 040 092

(51) Int. Cl.
*E04G 21/14* (2006.01)

(52) U.S. Cl. ..... 137/615; 141/387; 414/10

(58) Field of Classification Search ..... 137/615; 141/387; 414/10

See application file for complete search history.

(56) References Cited

U.S. PATENT DOCUMENTS

| | | | | |
|---|---|---|---|---|
| 3,985,234 | A | 10/1976 | Jouffray | |
| 6,226,955 | B1 | 5/2001 | Lorrigan | |
| 6,230,741 | B1 * | 5/2001 | Woodling et al. | 137/615 |
| 6,823,888 | B1 * | 11/2004 | Raymond | 137/615 |
| 6,983,763 | B2 * | 1/2006 | Benckert et al. | 141/387 |

FOREIGN PATENT DOCUMENTS

| | | |
|---|---|---|
| DE | 2 042 338 | 3/1972 |
| DE | 72 07 104 | 1/1976 |
| DE | 42 00 669 | 7/1993 |
| FR | 1 203 098 | 1/1960 |
| FR | 1 305 537 | 10/1962 |
| GB | 964 058 | 7/1964 |
| GB | 994 728 | 6/1965 |
| JP | 03-090777 | 4/1991 |

* cited by examiner

*Primary Examiner* — Kevin Lee
(74) *Attorney, Agent, or Firm* — Collard & Roe, P.C.

(57) ABSTRACT

The invention relates to an arrangement for conveying concrete for the construction of multi-storey concrete buildings. The arrangement comprises a concrete-distributing mast which is height-adjustable on completed parts of the building, for example on storey floors (48', 48", 48'"), the mast comprising a supporting column (10), a rotary unit (12) and an arm assembly (14) preferably designed as an articulated boom, and the mast being equipped with a conveying line (16) which is guided over the height of the supporting column (10) to the arm assembly (14) and which is supplied with liquid concrete. To facilitate the handling of the concrete-distributing mast during transportation and during the climbing operation, the invention proposes that the supporting column (10) has at least one channel-shaped surface depression (36, 38) extending in the longitudinal direction of the column, in which depression can be sunk that part of the conveying line (16) which extends over the supporting column (10), and/or an elongate part of the climbing apparatus (52).

15 Claims, 8 Drawing Sheets

ARRANGEMENT FOR CONVEYING CONCRETE WITH A HEIGHT-ADJUSTABLE CONCRETE DISTRIBUTING MAST

CROSS REFERENCE TO RELATED APPLICATIONS

This application is the National Stage of PCT/EP2007/056405 filed on Jun. 27, 2007, which claims priority under 35 U.S.C. §119 of German Application No. 10 2006 040 092.5 filed on Aug. 28, 2006. The international application under PCT article 21(2) was not published in English.

BACKGROUND OF THE INVENTION

1. Field of the Invention

The invention relates to an arrangement for conveying concrete for the construction of multi-storey concrete buildings, said arrangement including a concrete-distributing mast, which is height-adjustable on completed parts of the building, said mast comprising a supporting column, a rotary unit and an arm assembly that is preferably designed as an articulated boom, and including a conveying line, which is guided over the height of the supporting column to the arm assembly and is impinged upon with liquid concrete.

2. The Prior Art

An arrangement of this type with a height-adjustable concrete-distributing mast is known, where the supporting column, in the form of a tubular column, is constructed in a free-standing manner on an X-base at the start of the building work and, from there, initially two floors of the building are concreted. Floor apertures, through which the tubular column reaches, are formed in the formwork. Each floor aperture is equipped with automatically pivotable ratchets and with accommodating means for a hydraulic climbing apparatus. The hydraulic climbing apparatus comprises at least one hydraulic cylinder, at least one claw guided at the tubular column and automatically pivotable ratchets for the climbing operation. Once the first two floors with their floor apertures have been concreted, the climbing can begin. In this case, the tubular column is gradually displaced over one floor height at a time. In addition, after a total predetermined climbing lift, an extension piece of corresponding length has to be inserted into the conveying line. In the case of known climbing masts of this type (U.S. Pat. No. 6,226,955B1 and DE-4200669A1), the concrete-conveying line and the climbing apparatus are guided upwards to the arm assembly outside the supporting column, which in the majority of cases is in the form of a cylindrical column. This requires additional precautionary measures in the region of the floor aperture and when moving the supporting columns and these are deemed to be disadvantageous.

SUMMARY OF THE INVENTION

Proceeding from this point, it is the object of the invention to develop an arrangement for conveying concrete with a height-adjustable concrete-distributing mast, said arrangement enabling simplification of movement and simpler handling in the course of the climbing operation at the building.

To achieve this object, the feature combinations according to the invention are proposed. Advantageous developments and further developments of the invention are discussed below.

The solution according to the invention proceeds primarily from the concept that the handling of the climbing mast in the course of the climbing operation can be simplified in that the concrete-conveying line, which extends over the supporting column, and/or the climbing apparatus are sunk within the contour of the supporting portion, but are nevertheless positioned so as to be easily accessible. In order to achieve this, the invention proposes that the supporting column has at least one channel-shaped surface depression extending in the longitudinal direction of the column, in which, above all, the part of the conveying line extending over the supporting column can be sunk but still be positioned in an easily accessible manner. In an advantageous manner, the supporting column has an additional second channel-shaped surface depression, in which an elongate climbing apparatus of the climbing mast with climbing rail can be positioned. The two channel-shaped surface depressions, in this case, are expediently positioned on diametrically opposite sides of the surface of the supporting column.

A preferred development of the invention provides that the supporting column is composed of two column sections, which are detachably interconnected at the end face and have merging channel-shaped surface depressions in the region of the coupling point.

The climbing mast reaches with its supporting column expediently through apertures in the completed storey floors, the cross-sectional opening of said apertures being adapted and being somewhat oversized, and is supported so as to be height-adjustable at the boundary edges of said storey floors. Strength-increasing metal plates can be employed at the aperture edge for this purpose. For support, supporting ratchets or supporting journals are provided on a special climbing piece of the supporting column, it being possible to support the said ratchets or journals on the next lowermost storey floor after a climbing operation by lowering the supporting column.

Another preferred development of the invention provides that the supporting column or its column sections are in the form of rectangular tubes, and that the channel-shaped surface depressions are integrally formed in two oppositely situated side faces of the rectangular tubes. The surface depressions, in this case, can have a U-shaped or V-shaped inner profile.

According to an advantageous or alternative development of the invention, the concrete-distributing mast has a climbing apparatus, which includes a climbing rail fixed to the supporting column, a lower and an upper guide block guided on the climbing rail and a lifting mechanism supported between the lower and the upper guide block, the lower guide block having a supporting member facing outwards from the supporting column and the lower and the upper guide blocks each having a blocking element that is selectively couplable to the climbing rail. A preferred development of the invention provides that the climbing rail has several window openings positioned spaced apart, and that the blocking element is pressed against the climbing rail and is lockable at the level of the window openings in said window openings and there abuts in a blocking manner against the upper edge of the window opening with an upwardly facing stopping edge. The blocking element locks expediently into one of the window openings under the effect of a spring.

The lifting mechanism is advantageously in the form of a hydraulic cylinder, the cylinder and piston rod of which being connected to the lower and the upper guide block. The supporting member of the lower guide block is advantageously in the form of a pivoting claw, which is restrictedly pivotable in a selective manner between a displacement position, pivoted downwards against the guide block, and a support position, protruding outwards.

Another preferred development of the invention provides that the climbing apparatus includes a pulling mechanism that is positioned in the region of the upper end of the climbing rail, said pulling mechanism being operatively connected via a pulling member to the guide blocks, which, with the blocking elements unlocked, are guided along the climbing rail and are interconnected by the lifting mechanism.

Another preferred development provides that at least one supporting element, which is pivotable or displaceable between a displacement position and a support position, is positioned at the lowermost column section. Expediently, the lowermost column also has downwardly protruding coupling brackets, which are detachably connected to an X-base that is secured to the ground.

The achievement of these measures is that the concrete-distributing mast can be moved upwards in a gradual manner, with the supporting member of the lower guide block supported on a storey floor and with entrainment of the supporting column by the upper guide block that is locked into a window opening by its blocking member. In the extended end position of the lifting mechanism, the blocking member of the lower guide block locks into a window opening, so that the lifting mechanism can be moved back again with the upper guide block for the next lifting step, whilst the supporting column is retained by the lower guide block by its blocking member. This operation is repeated until the lower column section with its supporting element is situated above the next storey floor and can be locked in position there by securing the supporting column. In this position, the entire climbing apparatus, comprising the two guide blocks and the lifting mechanism situated therebetween, can be pulled upwards along the climbing rail through the aperture in the relevant storey floor with the aid of the pulling mechanism and can then be supported on the said storey floor by extending the supporting member that is situated at the lower guide block. The next storey floor can then be concreted from this position. To this end, the supporting column is wedged and secured in the apertures of the storey floors against tipping over.

The invention also relates to a supporting column for a climbing mast of a stationary concrete-distributing arrangement, which has at least one surface depression extending in the longitudinal direction of the column for accommodating elongate operating elements, such as conveying lines, climbing apparatuses or hydraulic lines and electric cabling. Accordingly, retaining elements are positioned in the surface depressions for securing a conveying line of an elongate climbing apparatus or corresponding operating elements.

BRIEF DESCRIPTION OF THE DRAWINGS

The invention is described in more detail below by way of an exemplary embodiment represented in a schematic manner in the drawing. In which.

DETAILED DESCRIPTION OF THE PREFERRED EMBODIMENTS

Figure 1A:
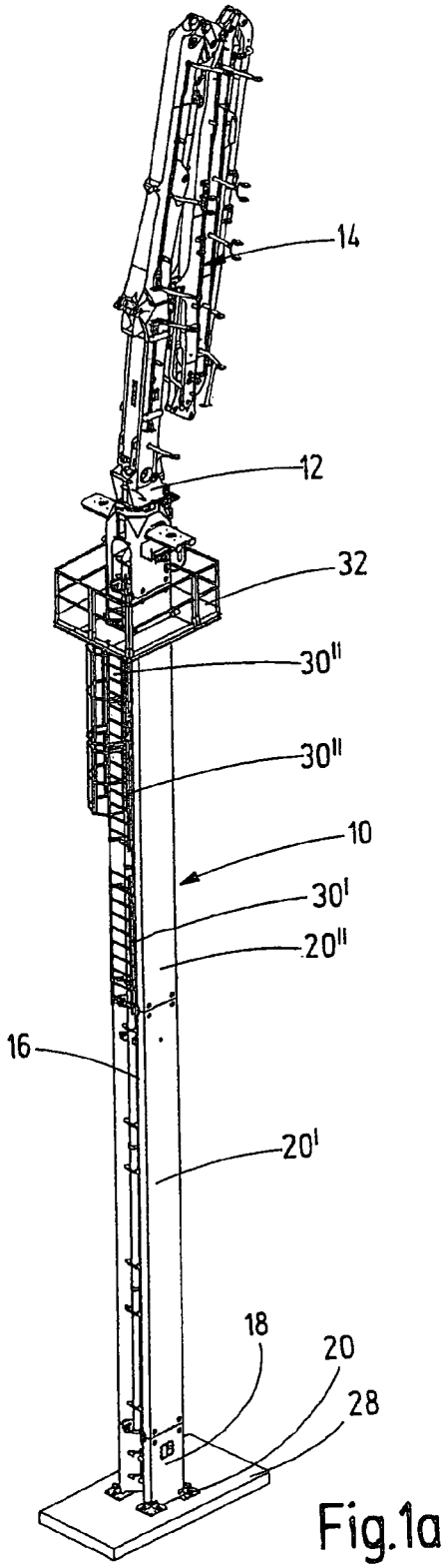
FIGS. 1*a* and *b* show a diagrammatic representation of a height-adjustable concrete-distributing mast with an X-base, in the starting position, with views of the tubing side and the side of the climbing apparatus.
Figure 1B:
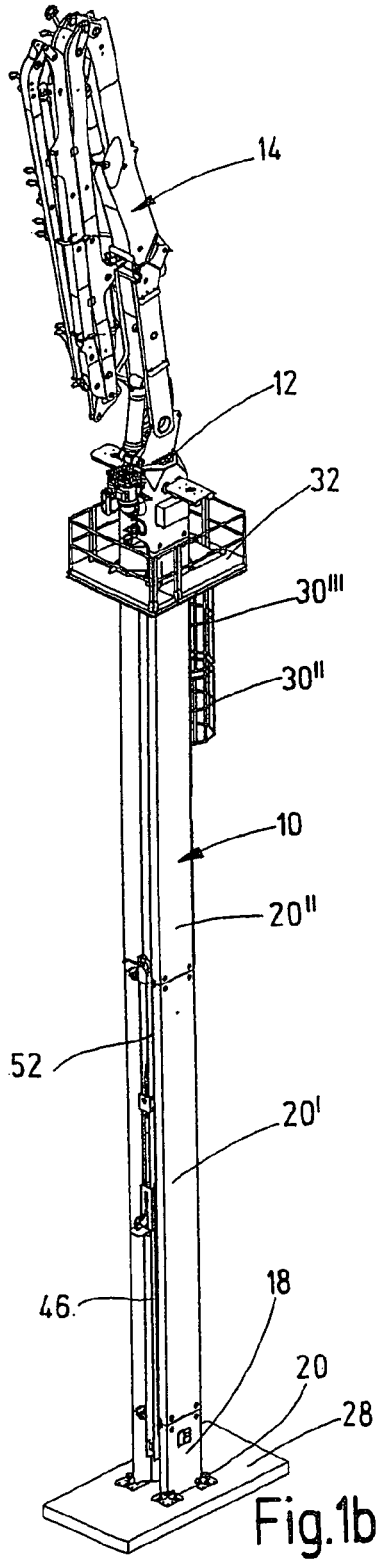
FIGS. 1*c* and *d* show a diagrammatic representation of the concrete-distributing mast reaching with its supporting column through apertures of previously concreted storey floors, in the raised position as opposed to the starting position, with views of the tubing side and the side of the climbing apparatus.
Figure 1C:
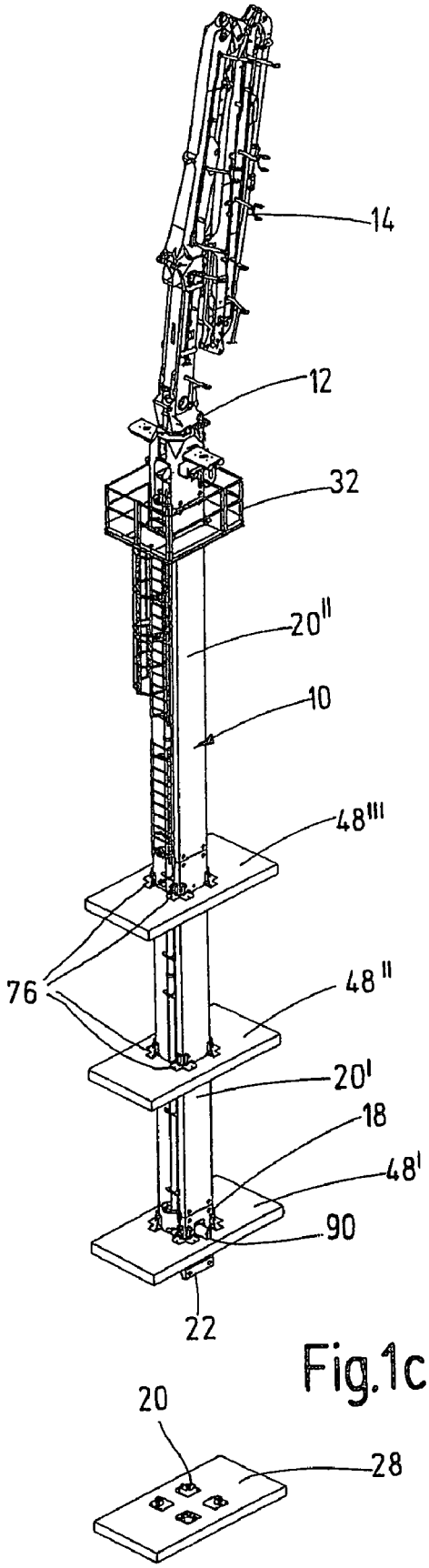
Figure 1D:
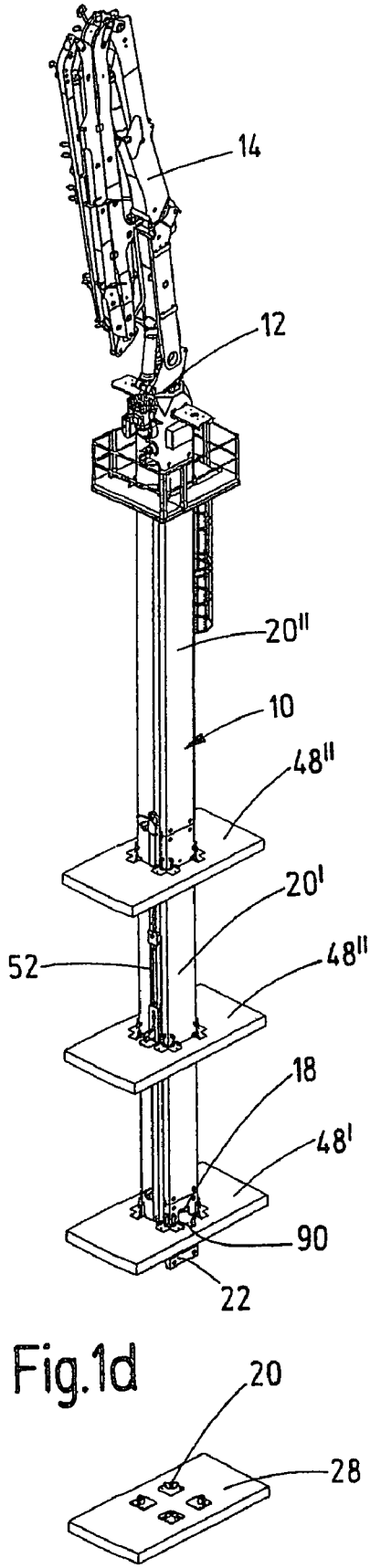

The height-adjustable, concrete-distributing mast, represented in the drawing, comprises essentially a supporting column 10, a rotary unit 12 positioned at the upper end of the supporting column 10, an arm assembly 14 in the form of an articulated boom and a conveying line 16, which is guided over the height of the supporting column 10 to the arm assembly 14 and is impinged upon with liquid concrete. The supporting column 10, in the exemplary embodiment shown, has three column sections 18, 20', 20", which are essentially in the form of rectangular tubes, which are rigidly interconnected at their end face ends in alignment with one another at axially protruding plates 22 by means of bolts 24. The lower, shorter column section 18, in this case, forms a climbing piece, which, at the start of the building work, is secured to an X-base 26 in the region of a bedplate 28. The two longer column sections 20', 20" are placed in position one after the other. A ladder, composed of a base ladder 30' and two ladder elements 30", 30'" provided with a protective cage, is secured to the outer side of the upper column section 20". The ladder opens out into a working platform 32 situated at the upper end of the upper supporting column 10. The rotary unit 12 is situated at the end face end of the upper column section 20", the arm assembly 14, via which the conveying line 16 is guided to an end hose, being mounted on said rotary unit.

Figure 2:
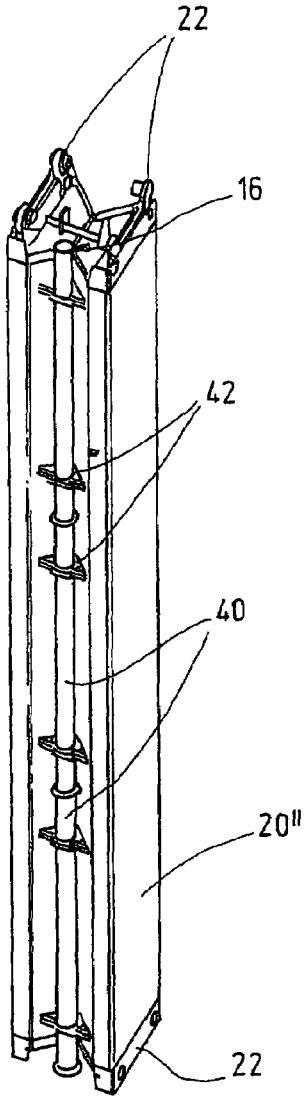
FIG. 2 shows a diagrammatic representation of a column section of the concrete-distributing mast with integrated conveying line.
Figure 3A:
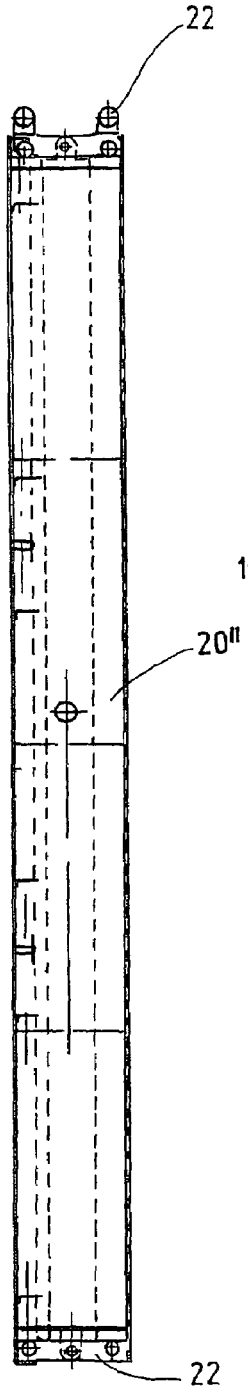
FIGS. 3*a* and *b* show two side views of the column sections in FIG. 2, rotated by 90° one relative to the other.
Figure 3B:
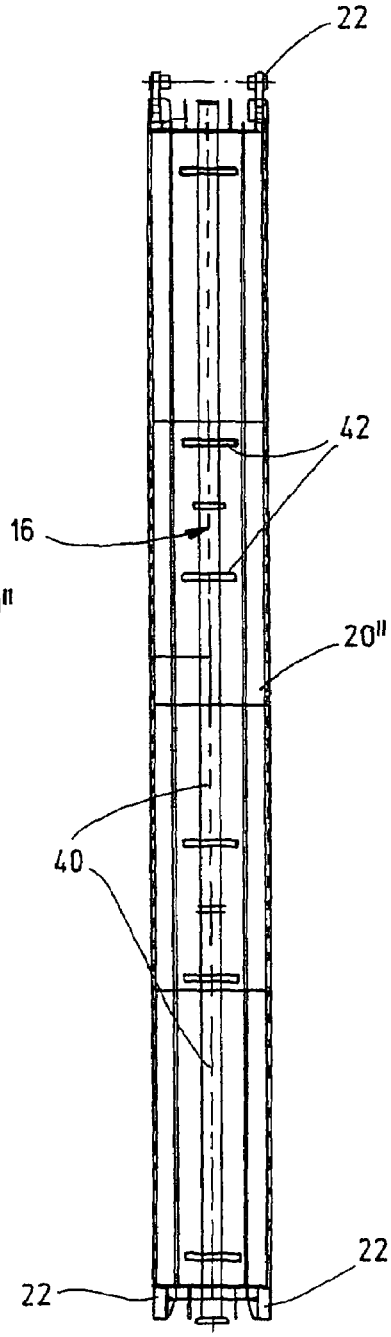
Figure 4:
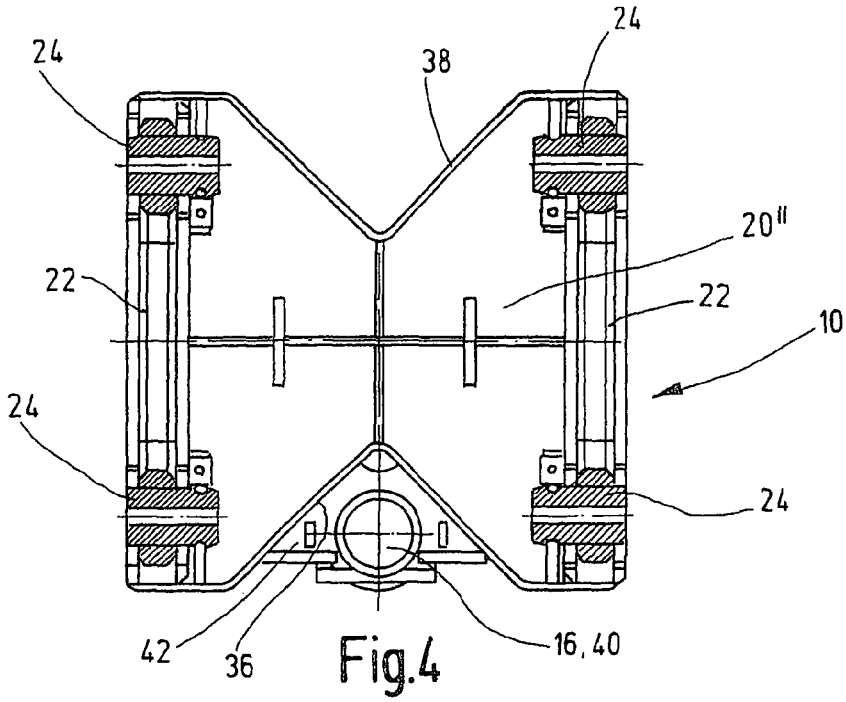
FIG. 4 shows a section along the line A-A in FIG. 3*b;*
Figure 5A:
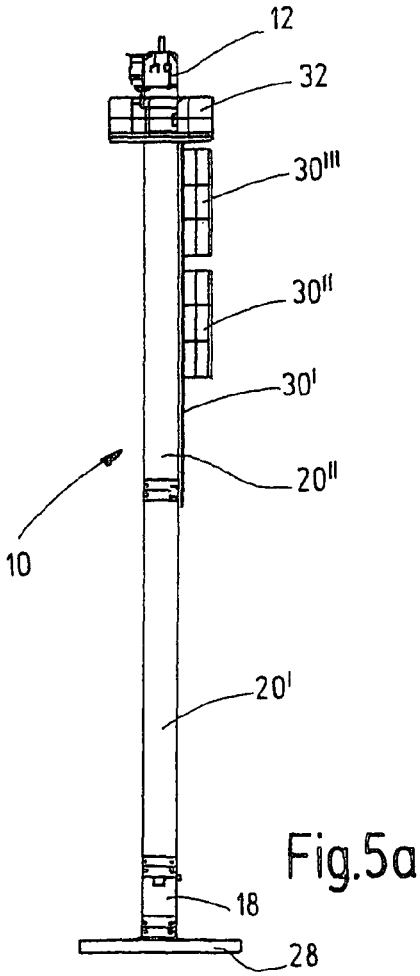
FIGS. 5*a* and *b* show two side views of a supporting column, which is standing on an X-base and is composed of three column sections, with rotary unit but no articulated boom.
Figure 5B:
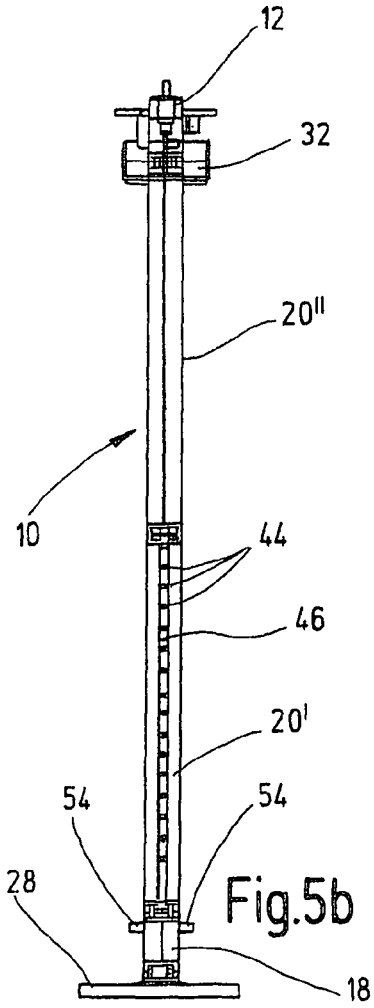
Figure 6:
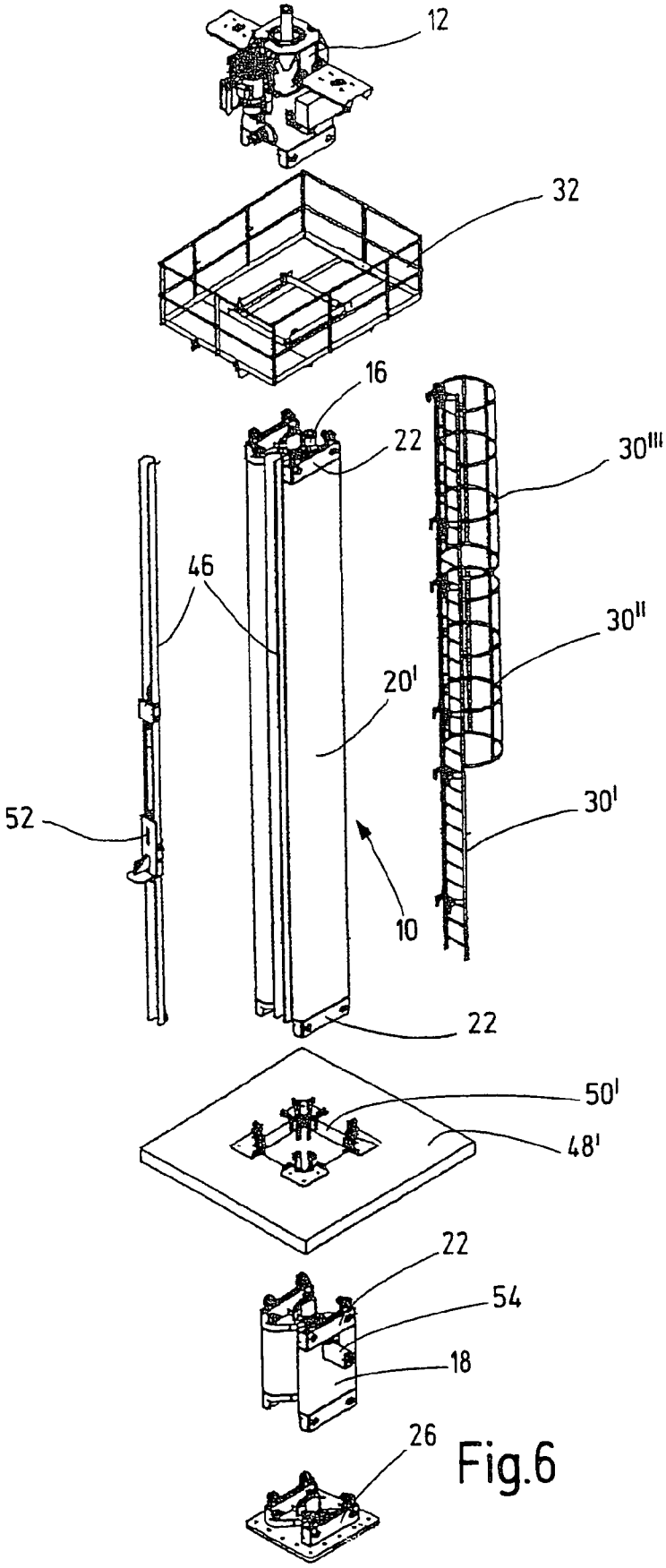
FIG. 6 shows a diagrammatic, exploded representation of the individual parts of the supporting column with rotary unit.
Figures 7A, 7B, 7C, 7D:
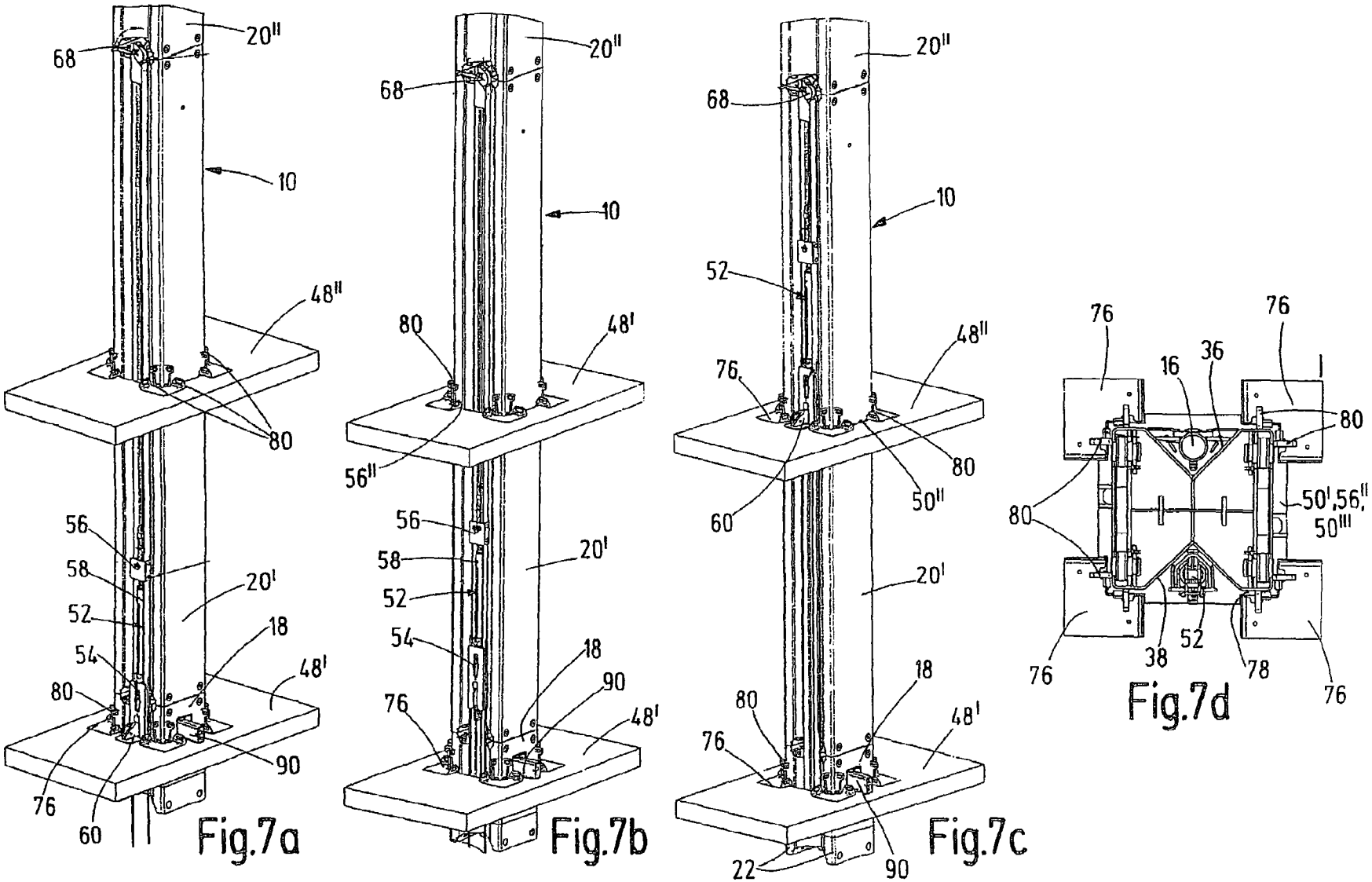
FIGS. 7*a* to *c* show a cutout from the climbing mast during the raising of the climbing apparatus, with three positions of the guide block, with the lifting mechanism between two storey floors.
FIG. 7*d* shows a top view of the climbing mast with channel-shaped surface depressions for accommodating the conveying line and the climbing apparatus.

A characteristic feature of the invention is that the supporting column 10, with its column sections 18, 20', 20", has, in the region of two oppositely situated side walls, in each case a channel-shaped surface depression 36, 38, which extends in the longitudinal direction of the column and, in the exemplary embodiment shown, has a V-shaped inner profile (cf. FIGS. 2, 4 and 7*d*). One of the two surface depressions 36 is intended for accommodating the tube sections 40 that form the conveying line 16 in the assembled state, said tube sections being positioned at tube supports 42 such that they are completely sunk into the surface depression 36 (cf. FIGS. 4 and 7*d*). The surface depressions 36, 38 are also suitable for accommodating supply lines and, in the case of the longer, lower column section 20', for accommodating a climbing apparatus 52 with elongate climbing rail 46 provided with window openings 44.

At the start of the building work, the distributing mast with its supporting column 10 is free-standing on the X-base 20 (FIGS. 1*a* and *b*). Two floors 48, 48" of the building are concreted initially from that position. Floor apertures 50', 50" are admitted in the formwork and the supporting column 10 reaches through said apertures. As an alternative to this, it is possible to prefabricate the first two floors 48', 48" of the building, for example using an automatic concreting pump, and to place the two pre-assembled column sections 18, 20' onto the X-base 20 through the floor apertures 50', 50" and to connect them to said base. The upper column section 20", to which the ladder 30', 30", 30" and at least a part of the working platform 32 has been attached beforehand, can then be placed onto the upper edge of the column section 20' and finally equipped with the arm assembly 14. In both cases, the third storey floor 48'" is concreted from the starting position.

The first two storey floors 48', 48", in the region of the apertures 50', 50", ensure that the supporting column 10 can be held in its vertical orientation. During the concreting of a new storey floor 48'", the supporting column is secured to the storey floors 48', 48" by wedges in the region of the apertures 50', 50'.

Figure 8A:
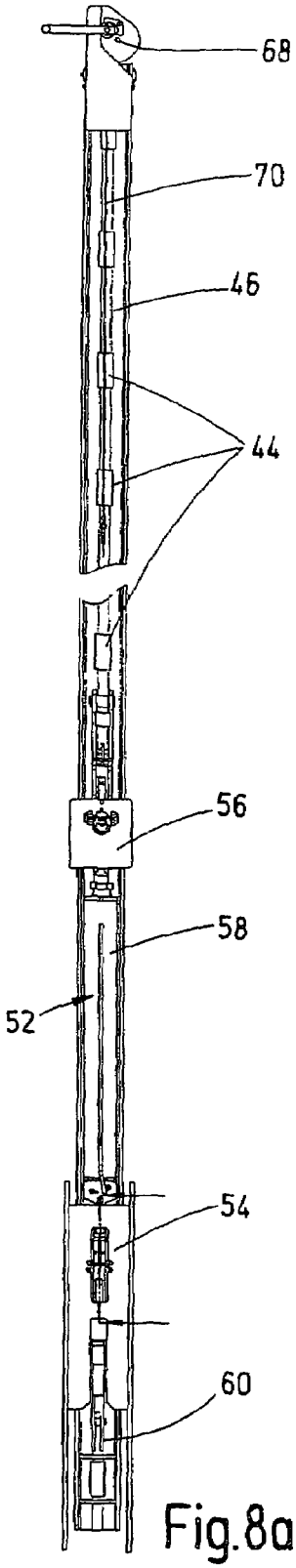
FIGS. 8*a* to *c* show a side view and two diagrammatic representations of the climbing apparatus.
Figure 8B:
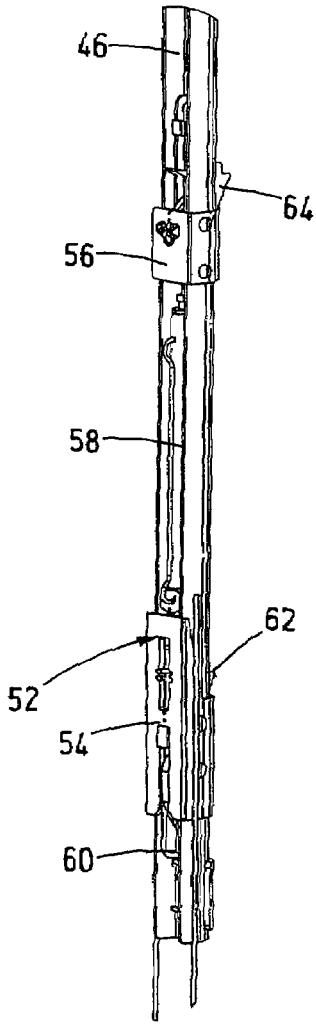
Figure 8C:
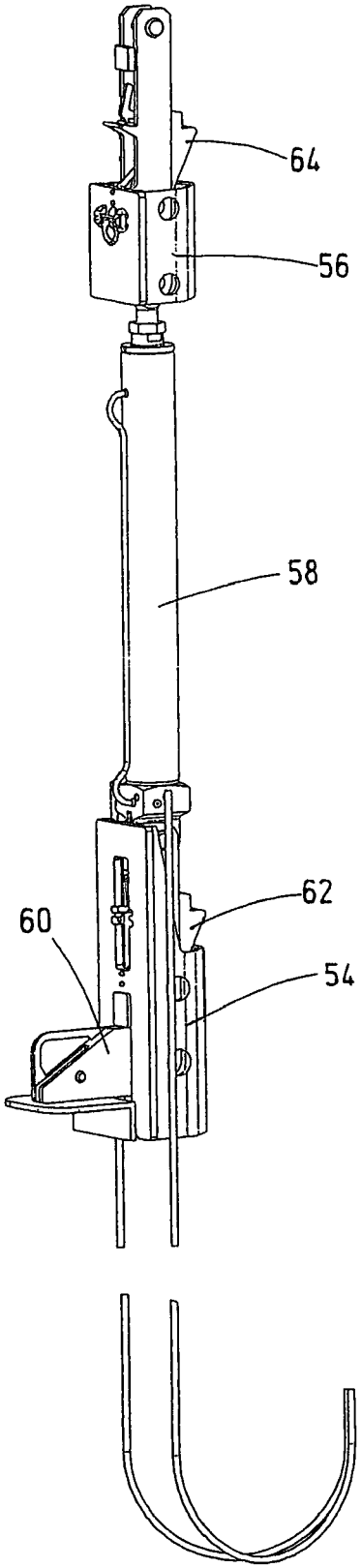
Figure 8D:
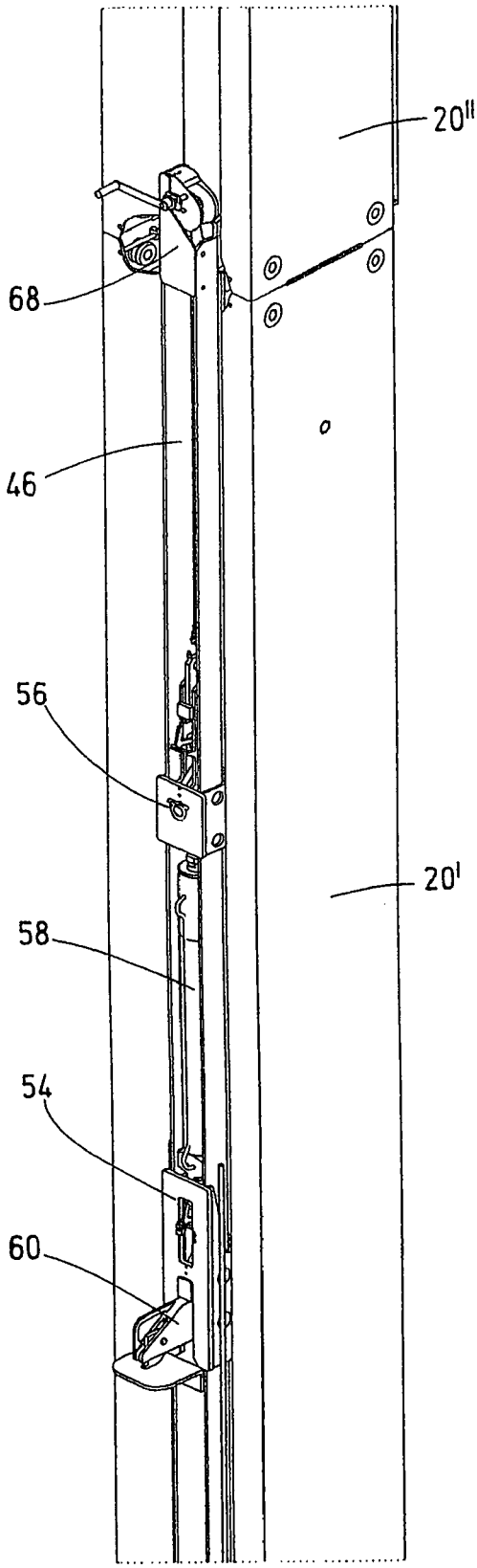
FIG. 8*d* shows a diagrammatic representation of a cutout of the supporting column with climbing apparatus.

Once the third floor 48'", with its aperture 50'", has also been concreted, the climbing can be started. To this end, first of all the wedging is removed from the apertures 50', 50". In addition, the supporting column 10 is separated from the X-base 20 before the first lifting movement. Thereupon the supporting column 10 is gradually displaced upwards above the respective lowest floor height. This is effected with the aid of a climbing apparatus 52, which includes a climbing rail 46 that is positioned in a surface depression 38 of the column section 20', a lower and an upper guide block 54, 46 guided on the climbing rail 46 and a lifting mechanism 58, which is positioned between the lower and the upper guide blocks and is in the form of a hydraulic cylinder. The lower guide block 54 has a supporting member 60, in the form of a pivoting claw, which is pivotable in a limited manner between a displacement position, pivoted down against the guide block (FIG. 8*b*), and a support position, protruding outwards (FIGS. 8*c* and *d*). In addition, the lower and the upper guide blocks 54, 56 have a ratchet-like blocking member 62, 64, which is selectively couplable to the climbing rail 46 in the region of the window opening 44. Each blocking member 62, 64 is pressed against the climbing rail under the effect of a spring 66 so that they lock into the window opening 44 of the climbing rail 46 and there can abut, in a blocking manner, against the upper edge of the window opening. The climbing apparatus, with the lifting mechanism 58 and the blocking members 62, 64 positioned at the guide blocks 54, 56, enables the supporting column to be lifted along the climbing rail 46 in a gradual manner.

In order to ensure precise guiding in the region of the apertures, guide plates 76 with rectangular ratchets 78 are secured to the storey floors at the aperture corners, the supporting column 10 being guided in its end region at said ratchets. The surface depressions 36, 38 are slightly offset inwards for this purpose so that the surface regions adjacent to the edges of the ratchets 78 extend parallel to the ratchets (cf. FIG. 7*b*). The wedges 80 provided for wedging the supporting column 10 are also positioned there (FIGS. 7*a* to *d*).

In the climbing operation, the lower guide block is supported, with the aid of its supporting member 60, on the respectively lowest storey floor, whilst the upper guide block 56 locks into a window opening 44 of the climbing rail 46 with its blocking member 62. Thereupon the lifting cylinder of the lifting mechanism 58 is impinged upon with pressure oil, so that the upper guide block 46 is moved upwards entraining the supporting column 10. In the upper end position of the lifting mechanism 58, the blocking member 64 of the lower guide block 54 locks into an adjacent window opening of the climbing rail under the effect of the associated spring 66 and secures the supporting column in its raised position, whilst the upper guide block 46 is moved back down again by the lifting mechanism 58 and with its blocking member 64 once again locks into a window opening 44. Thereupon another lifting step is triggered. This operation is repeated until the lowermost column section 18 of the supporting column reaches through the aperture 50' of the relevant storey floor 48 with its supporting element 90. There the supporting element 90 is extended and from that point onwards takes over the supporting of the concrete-distributing mast whilst the next storey floor is concreted.

Figure 9A:
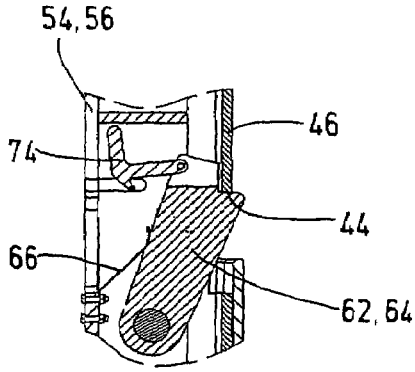
FIGS. 9*a* and *b* show a cutout from the upper or lower guide block, with the blocking ratchet in the blocking position and in the release position.
Figure 9B:
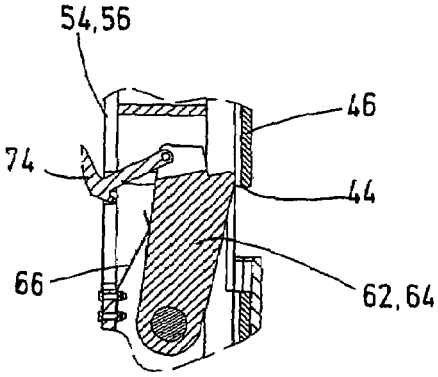

Before the concreting operation, the supporting column is once again wedged in the apertures 50", 50'" of the floors 48", 48'" and the guide blocks 54, 56, together with the lifting mechanism 85 of the climbing apparatus, are pulled upwards by one storey through the aperture 50" in the storey floor 48" (FIGS. 7*a* to *c*). For this purpose, the climbing apparatus 52 has a pulling mechanism 68, which, in the exemplary embodiment shown, is in the form of a cable winch, which is secured in the upper region of the climbing rail 38 and is operatively connected to the guide blocks 54, 56 and the lifting mechanism 85 by means of a hauling cable 70. In order to be able to pull the guide blocks 54, 56 upwards, the blocking members 62, 64 have to be pulled into their pivoted position, which can be effected, for example, in opposition to the force of the springs 66 by means of the hauling cable 70 using a pivoting lever 74 that is situated in the guide blocks (FIGS. 9*a* and *b*). The guide blocks 54, 56, positioned sunk in the surface depression 38 of the associated column section 20', together with lifting mechanism 58 pass through the essentially rectangular apertures 50', 50", 50'" of the storey floors. During the raising operation, the supporting member 60 in the lower guide block 54 is pivoted downward so that it also passes through the relevant aperture. In the end position pulled upward, the supporting member 60 is pivoted outwards again and lowered onto the storey floor. Consequently, the lifting mechanism is ready for another lifting movement of the concrete-distributing mast as soon as the next storey floor, with aperture, has been completely concreted. The lifting operation can be repeated in an arbitrary manner until the final storey floor is completed. Finally, the open floor apertures 50' 50", 50'" are closed by means of a concrete cover.

The following must be emphasized in summary: The invention relates to an arrangement for conveying concrete for the construction of multi-storey concrete buildings. The arrangement includes a concrete-distributing mast, which is height-adjustable on completed parts of the building, for example on storey floors 48', 48', 48'", said mast comprising a supporting column 10, a rotary unit 12 and an arm assembly 14 that is preferably in the form of an articulated boom, and including a conveying line 16, which is guided over the height of the supporting column 10 to the arm assembly 14 and is impinged upon with liquid concrete. In order to simplify handling of the concrete-distributing mast during movement and during the climbing operation, the invention proposes that the supporting column 10 has at least one channel-shaped surface depression 36, 38 that extends in the longitudinal direction of the column, it being possible for the part of the conveying line 16 that extends over the supporting column 10 and/or an elongate part of the climbing apparatus 52 to be sunk in said surface depression.

The invention claimed is:

1. A concrete-distributing arrangement with a climbing mast, which has a supporting column for accommodating a concrete-conveying line, wherein the supporting column has at least two column sections, which are in the form of rectangular tubes, are detachably interconnected at their end faces and are provided with channel-shaped surface depressions extending in the longitudinal direction of the column on two diametrically opposite side faces for accommodating elongate operating elements, the concrete-conveying line being accommodated in one of the surface depressions.

2. The concrete-distributing arrangement as claimed in claim 1, wherein at least one of the surface depressions has a U-shaped or V-shaped inner profile.

3. The concrete-distributing arrangement as claimed in claim 1, wherein retaining elements for securing the concrete-conveying line are sunk in one of the surface depressions.

4. The concrete-distributing arrangement as claimed in claim 1, wherein a climbing rail of a climbing apparatus is sunk in one of the surface depressions.

5. The concrete-distributing arrangement as claimed in claim 4, wherein the climbing rail is fixed to the supporting column, and the climbing apparatus further comprises a lower and an upper guide block guided on the climbing rail and a lifting mechanism supported between the lower and the upper guide blocks, wherein the lower guide block has a supporting member facing outwards from the supporting column and the lower and the upper guide blocks each have a blocking element that is optionally couplable to the climbing rail.

6. The concrete-distributing arrangement as claimed in claim 5, wherein the climbing rail has several window openings positioned spaced apart, and that the blocking elements are pressed against the climbing rail and are lockable in its window openings and, in so doing, abut in a blocking manner against an upper edge of the window opening.

7. The concrete-distributing arrangement as claimed in claim 5, wherein the blocking members are lockable in the window openings under the effect of a spring.

8. The concrete-distributing arrangement as claimed in claim 5, wherein the lifting mechanism comprises a hydraulic cylinder mechanism having a cylinder and a piston rod coupled to each of the guide blocks.

9. The concrete-distributing arrangement as claimed in claim 5, wherein the supporting member comprises a pivoting claw, wherein the supporting member is restrictedly pivotable in a selective manner between a displacement position, pivoted downwards against the guide block, and a support position, protruding outwards.

10. The concrete-distributing arrangement as claimed in claim 5, wherein the climbing apparatus includes a pulling mechanism, which is positioned near an upper end of the climbing rail, said pulling mechanism being operatively connected via a pulling member to the guide blocks, which, with the blocking elements unlocked, are guided along the climbing rail and are interconnected by the lifting mechanism.

11. The concrete-distributing arrangement as claimed in claim 10, wherein the pulling mechanism comprises a pull lift device.

12. The concrete-distributing arrangement as claimed in claim 1, wherein at least one supporting element, which is pivotable or displaceable between a displacement position and a support position relative to the supporting column, is positioned at a lowermost column section, the lowermost column section serving as a climbing piece.

13. The concrete-distributing arrangement as claimed in claim 1, wherein a lowermost column section has downwardly facing coupling brackets, which are detachably connected to an X-base that is secured to the ground.

14. The concrete-distributing arrangement as claimed in claim 1, wherein the supporting column is a part of a height-adjustable concrete-distributing mast, which has a rotary unit and an arm assembly comprising an articulated boom and wherein the concrete-conveying line is guided over the height of the supporting column to the arm assembly and beyond the arm assembly.

15. The concrete-distributing arrangement as claimed in claim 14, wherein the concrete-distributing mast with its supporting column reaches through openings in completed storey floors and is guided at guide plates fixed in opening corners of the openings.

* * * * *